US005251882A

United States Patent [19]

Kämmerling et al.

[11] Patent Number: 5,251,882

[45] Date of Patent: Oct. 12, 1993

[54] LIQUID-CARRYING COOLING ELEMENT FOR SHAFT FURNACES

[75] Inventors: Bruno Kämmerling, Dinslaken; Karl Spickermann, Dorsten; Urs-Peter Steiner, Viersen, all of Fed. Rep. of Germany

[73] Assignee: Man Gutehoffnungshütte AG, Oberhausen, Fed. Rep. of Germany

[21] Appl. No.: 559,839

[22] Filed: Jul. 30, 1990

[30] Foreign Application Priority Data

Jul. 31, 1989 [DE] Fed. Rep. of Germany ..... 3925280

[51] Int. Cl.[5] ..... C21B 7/10

[52] U.S. Cl. ..... 266/193; 29/890.03; 122/6 B

[58] Field of Search ..... 266/193, 194; 29/890.03, 890.043; 122/6 B

[56] References Cited

U.S. PATENT DOCUMENTS 3,953,008 4/1976 Bashinsky et al. ..... 266/193
3,984,089 10/1976 van Laar et al. ..... 266/193
4,437,651 3/1984 Cordier et al. ..... 266/193
4,561,639 12/1985 Kudinov et al. ..... 266/193

FOREIGN PATENT DOCUMENTS 35708 2/1988 Japan .
2-47211 2/1990 Japan .
1571789 7/1980 United Kingdom .

*Primary Examiner*—Melvyn J. Andrews
*Attorney, Agent, or Firm*—McGlew & Tuttle

[57] ABSTRACT

A cooling element for shaft furnace walls including a metallic plate body with interior coolant-carrying tubes. The lower edge of the plate body includes a holding nose for refractory brickwork. The nose has at least one additional cooling tube. The cooling element according to the present invention may be assembled completely outside the furnace in a shop. The refractory brickwork consists of small bricks which are adhered or cemented to the plate body in concentric ring sections. The refractory bricks are advantageously provided with predetermined breaking notches and the layers of brick of the brickwork are provided with expansion joints. It is possible to use bricks with different thermal conductivities for the refractory brickwork.

11 Claims, 4 Drawing Sheets

LIQUID-CARRYING COOLING ELEMENT FOR SHAFT FURNACES

BACKGROUND OF THE INVENTION

FIELD OF THE INVENTION

The invention relates in general to furnace wall construction and in particular to a new and useful liquid-carrying cooling element for shaft furnace walls especially blast furnace walls.

The inventive construction includes a plate body made of cast iron or similar metal with coolant-carrying tubes which are arranged inside it, which extend substantially parallel to the hot side of the associated furnace, and exit on the cold side. The wall is advantageously equipped with predominantly horizontally extending brickwork supports on the hot side.

Such cooling elements are usually arranged between the steel jacket of the furnace and the furnace lining and are connected to the cooling system of the shaft furnace. On the side facing the inside of the furnace, the cooling elements are provided with refractory material.

In the case of a shaft furnace, the life of a furnace depends mainly on the service life of the refractory lining. Besides the selection of resistant grades of refractory materials, good cooling of the refractory material contributes to the prolongation of the service life.

The cooling method involving the use of liquid-carrying cooling elements has proved to be particularly successful. Contrary to other methods, it brings about uniform, whole-surface cooling of the shaft furnace wall and consequently of the furnace lining as well.

The first lining or the relining of a furnace was previously performed by first mounting the cooling elements, i.e., the metallic plate bodies, on the inner surface of the steel jacket of the furnace and subsequently installing a refractory lining from bottom to top. The annular gap formed was carefully pointed with mortar for heat transfer between the refractory lining and the plate bodies.

The wear on the refractory lining is determined mainly by chemical, mechanical, and thermal stresses. The thermal stress on the plate bodies increases with progressive wear of the lining. Finally, the chemical and mechanical stresses on the plate body reach their maxima on complete loss of the refractory lining.

SUMMARY OF THE INVENTION

In accordance with the invention the furnace life is prolonged by intensifying cooling and reducing the time needed for installation of the cooling elements both for the initial lining and/or the relining of a shaft furnace.

The inventive construction makes it possible to have a shorter time for lining the shaft furnace and consequently a reduction of the downtime, a better connection between the refractory brickwork and the metallic plate bodies, a guaranteed improvement in heat dissipation and optimal cooling of the brickwork, and consequently also prolonged service life of the cooling elements.

The integrally cast nose of the plate body, due to being arranged on the lower narrow side of the plate body, forms a firm support for the refractory brickwork.

In case of destruction and loss of a layer of bricks after prolonged operating time, this damage is usually limited by the nose according to the present invention to a single cooling element, so that the adjacent cooling elements are not affected.

The predetermined breaking notches provided in the refractory bricks prevent the entire refractory lining from being lost. Instead any deterioration takes place layer by layer and is retarded. Pre-lining within the furnace is dispensed with. The lining operations are carried out in the shop under favorable ergonomic conditions. The mode of operation, and the elimination of time pressure are condutive to improved quality of work.

Since the expansion characteristics of the refractory lining have been known to differ from those of the plate bodies, small bricks are selected for the cooling element according to the present invention. Both thermal and mechanical stresses can be eliminated by standard joints. If this is not sufficient in the case of certain grades of refractory material, additional expansion joints are provided in the refractory part of the cooling element.

Corresponding to the stress in the individual concentric ring layers, it is possible to select bricks with different expansion characteristics and different resistance to mechanical abrasion and chemical corrosion. For example, it is possible to use a material with high thermal conductivity, e.g., for the first layer that is close to the plate body, and a material with lower thermal conductivity for the layers more remote from the plate. It is obvious that the brick material should be as resistant to abrasion and chemical corrosion as possible.

In certain areas of the shaft furnace with low stress, the refractory brickwork according to the present invention can also be supported on shorter holding noses. The use of such cooling elements is possible, for example, in the upper shaft of the furnace. It is also possible to completely dispense with the installation of holding noses on the plate bodies of the cooling elements, e.g., in the belly of the shaft furnace.

In accordance with the invention a cooling element for a furnace particularly a shaft furnace is provided which includes a metallic plate which is formed with a cooling conduit therein and is provided with a nose formation at its inner furnace facing hot side which forms a support for refractory brick which is formed on a cooling element.

A further object of the invention is to provide a cooling element which may be pre-fabricated before installation in a furnace such as a shaft furnace and which may be positioned in the furnace with the refractory already secured thereto.

A further object of the invention is to providing a cooling element for furnaces which comprises forming a cooling plate with at least one cooling conduit formed in the interior of the plate and with a furnace facing hot side which has an outwardly projecting nose and securing a refractory to the plate hot side over the nose and which is advantageously provided with refractory brick securing recesses on the hot side face.

A further object of the invention is to provide a cooling element for a shaft furnace which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE PREFERED EMBODIMENT

In the drawings:

FIG. 1 is a sectional view of a cooling element constructed in accordance with the invention.

FIG. 2 and 3 similar to FIG. 1 indicating various embodiments of the invention; and FIG. 4 is an elevational view of the cooling element shown in FIG. 1.

DETAILED DESCRIPTION OF THE PREFERED EMBODIMENT

Figure 1:
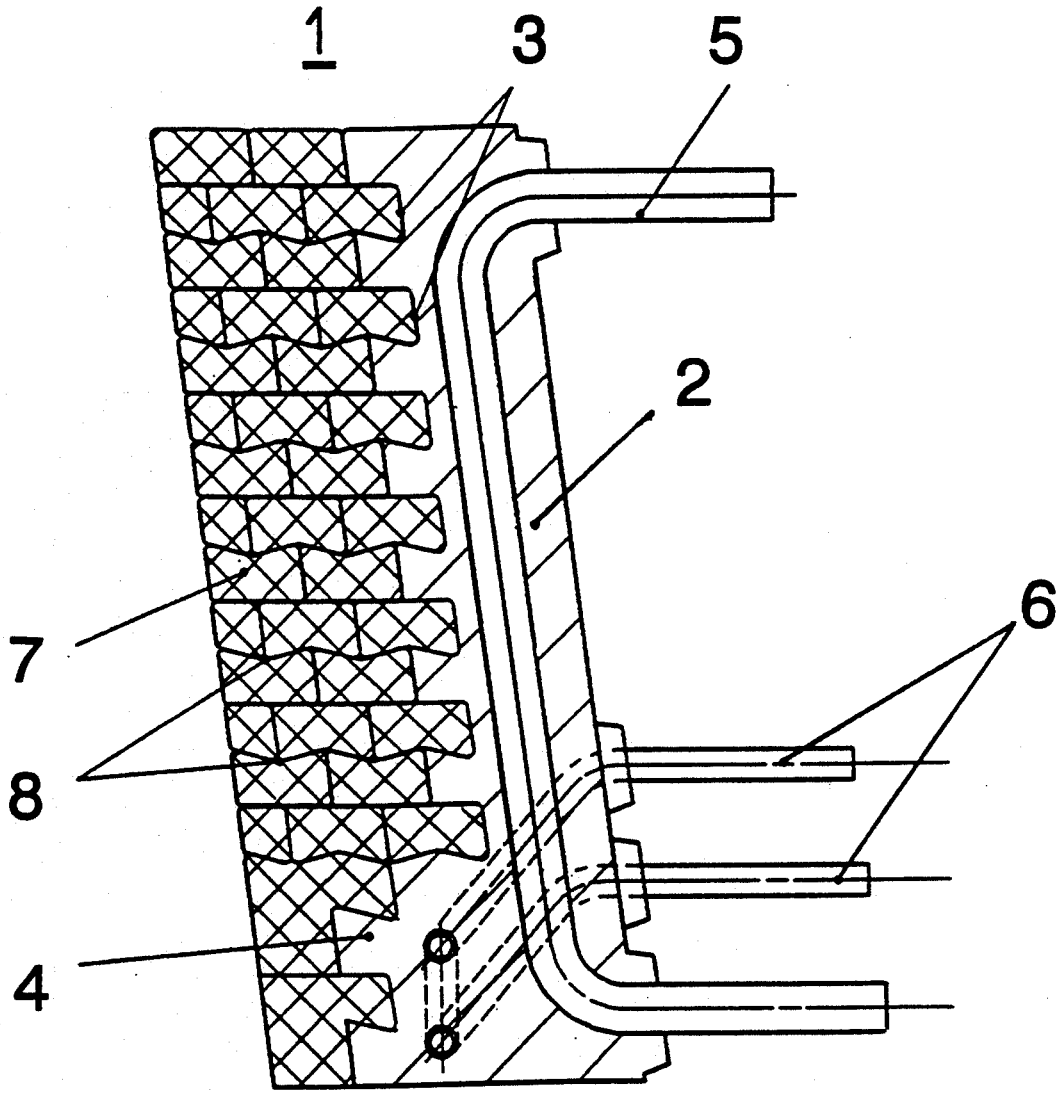

Referring to the drawings inparticular the invention embodied therein comprises a cooling element generally designated 1 which may be completely pre-fabricated in a manner such that it may be fitted into a shaft furnace or similar furnace in an easy and inexpensive manner.

The cooling element, generally designated 1 includes metallic plate bodies 2 with the coolant-carrying tubes 5 and 6 and a refractory lining 7. Said plate body 2 preferably consists of cast iron. The coolant tubes 5 and 6 are preferably made of steel.

The plate body 2 has, at its lower edge a holding nose 4 projecting toward the hot side or inside the furnaces as shown by the arrow 40, which serves to support the small bricks of refractory lining 7. The entire end face of plate body 2 facing the inside of the furnace is provided with recesses and projections forming brickwork supports 3.

Figure 2:
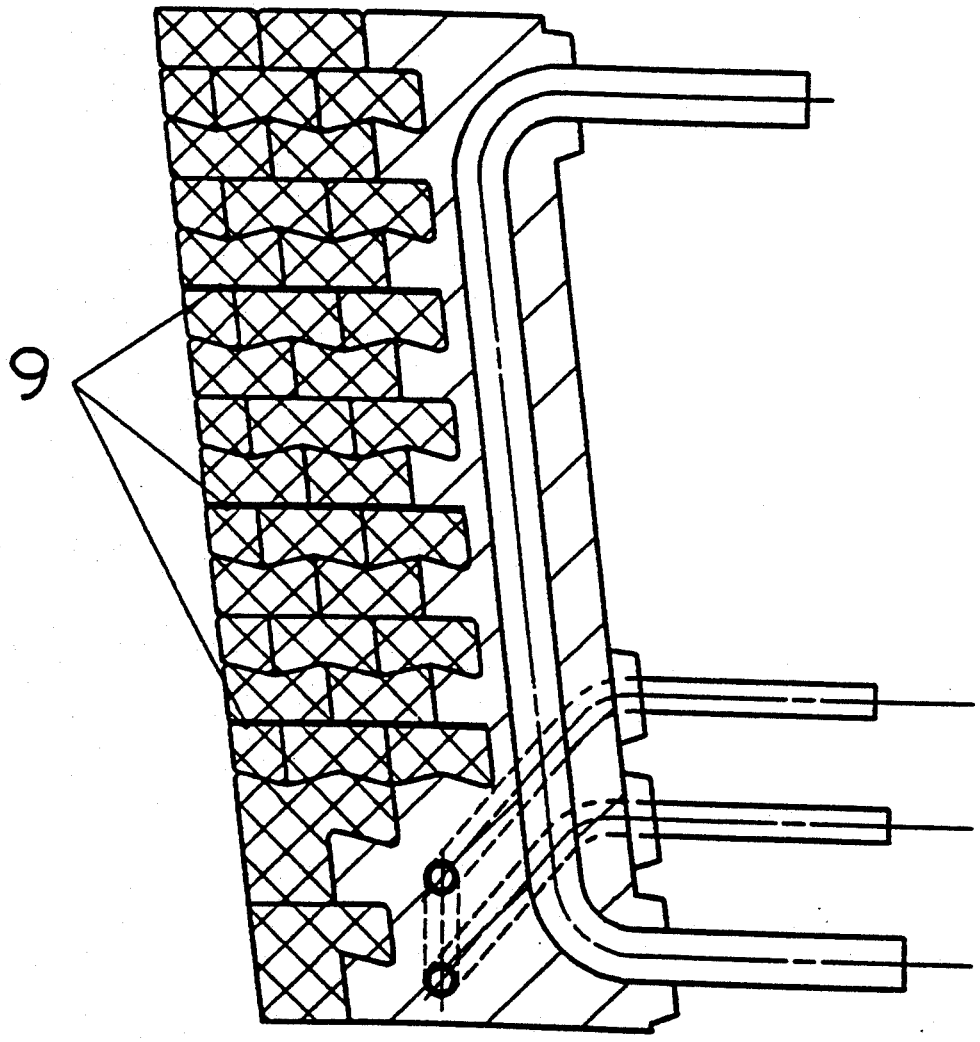
Figure 3:
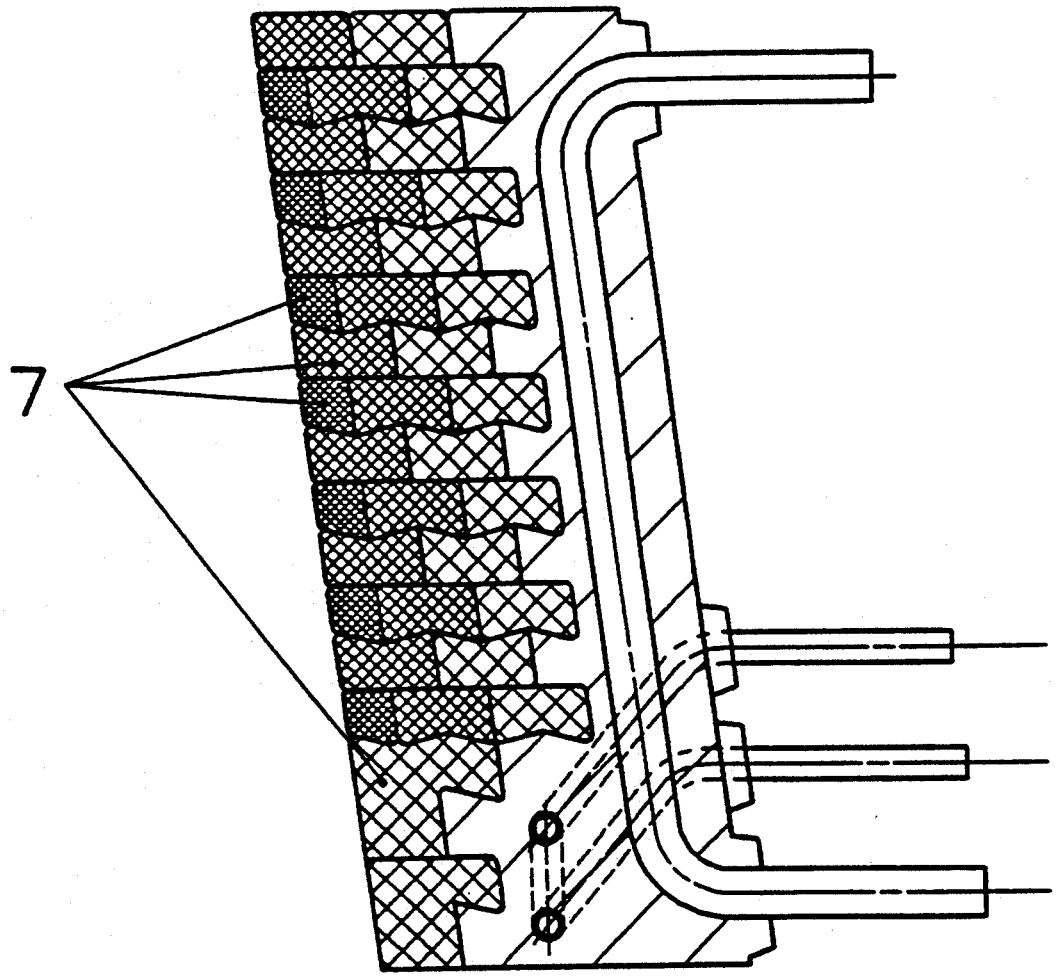
Figure 4:
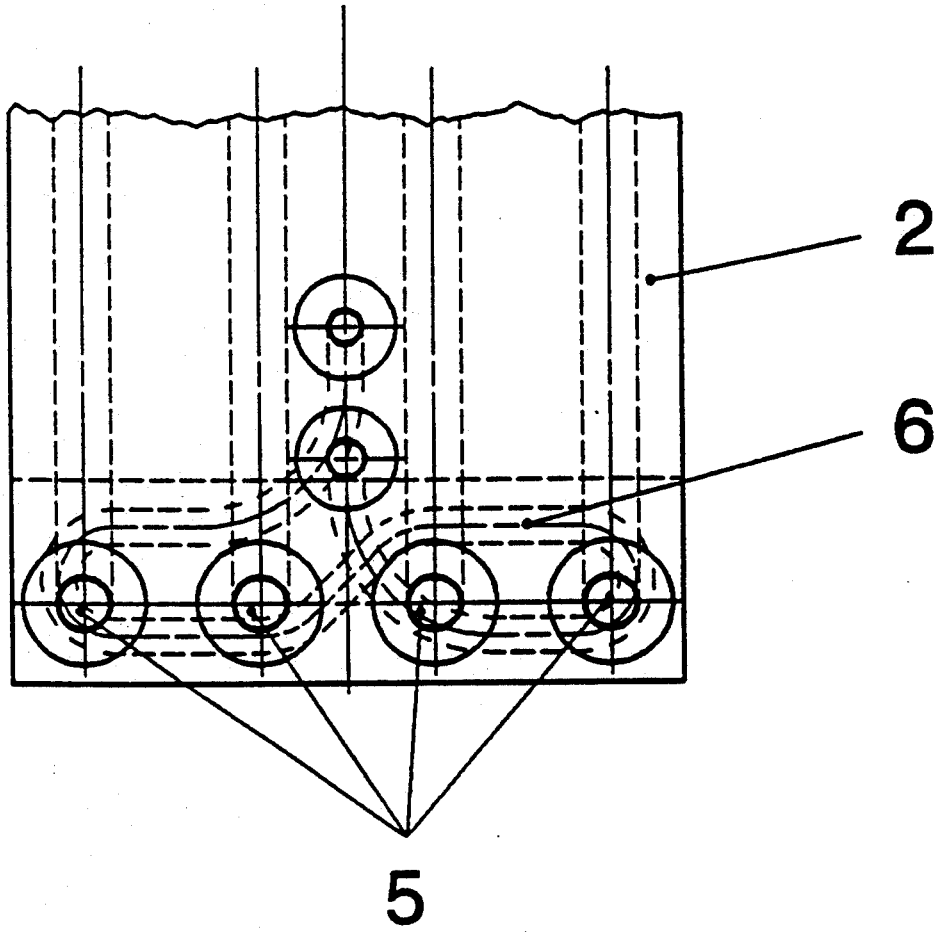

FIGS. 1-3 show longitudinal sections of one of the main cooling tubes 5 with inlet and outlet, as well as the nose cooling tubes 6 for cooling the holding nose 4. In FIG. 4, both the nose and the main cooling tube are shown in an elevation and on a larger scale, with inlets and outlets. The nose cooling tube 6 has the shape of a horizontal figure eight, as a result of which uniform cooling of the area of the holding nose is achieved.

The other main cooling tubes not shown in the drawings are arranged in parallel to the cooling tube represented. A single nose cooling tube 6 is normally sufficient to cool said holding nose 4. However, it is also possible to arrange additional cooling tubes if desired.

The refractory lining 7 is composed of small bricks which are assembled, after casting, then into the one-piece cooling element 1 by adhesion or cementing.

This preferred cooling wall unit or element 1 can be considered to be a principal advantage of the cooling element according to the present invention over the prior-art cooling plates. The cooling elements according to the present invention can be manufactured as complete, ready-to-install products, i.e., including the refractory lining, in a shop, without time pressure and furnace downtime and under favorable ergonomic conditions. After installation of the complete cooling elements in the furnace wall, only the horizontal and vertical joints toward the adjacent cooling elements are to be sealed subsequently with mortar. Each cooling element is designed according to the present invention in such a way that long service life in the shaft furnace is guaranteed, and the separately cooled holding nose arranged on the lower side of the plate body reliably supports the refractory lining of the cooling element.

The refractory bricks of the brickwork 7, which are provided with grooves and extending in a circumferential direction (laterally along the face of the plate body 2), have notches or recesses 8 on one side, which serve to cause better interengagement and provide predetermined breakage or separation of only one ring layer of the refractory lining rather than breaking off of the entire refractory lining of the cooling element. These or prepositional breaking notches 8 may also be provided on both sides of the bricks.

The bricks of the brickwork 7 have all-around joints by which the mechanical and thermal stresses are compensated. In addition, as is apparent from FIG. 2, horizontal expansion joints 9 on opposite brick sides or faces may also additionally be provided in the refractory lining 7.

Different crosshatching in FIG. 3 indicates that refractory bricks of different qualities can be used to line the hot side of said cooling element 1. This permits better adjustment to locally different temperatures, and mechanical and chemical stresses. For example, bricks made of a material with high abrasion resistance and lower thermal conductivity are selected for the surface of the cooling element facing the inside of the furnace, whereas bricks made of a material with high thermal conductivity are preferably selected for the layer close to the plate body.

What is claimed is:

1. A liquid carrying cooling element for shaft furnace walls of a blast furnace, comprising; a plate body extending from a plate body upper end to a plate body lower end, said plate body being made of metal having a first side intended as a furnace heat facing hot side and an opposite second side and having an interior coolant carrying conduit extending inside said plate body substantially parallel to said first side and also having an exit on said second side, said plate body having a face on said first side, defining a brick work support formed integral with said plate body on said first side, said brick work support extending from said body plate upper end to said body plate lower end and said plate body defining a holding element extending said plate body outwardly on said first side beyond said face; a holding element cooling tube formed in said holding element adjacent said first side of said plate body; and, brick work secured to said plate body on said first side.

2. A liquid carrying cooling element according to claim 1 wherein said brick work comprises small bricks which are provided with prepositioned breaking notches.

3. A cooling element according to claim 1 wherein: said brick work including bricks which are provided with grooves and tongues extending in a circumferential direction.

4. A cooling element according to claim 1 wherein: said brick work includes bricks formed with resistance to abrasion and positionable in concentric rings and having a first thermal conductivity provided for an individual concentric ring of said brick work formed adjacent said plate and bricks formed having a higher thermal conductivity than said first thermal conductivity provided for an individual concentric ring of said brick work facing an inside of the blast furnace.

5. A cooling element according to claim 1 wherein: said brick work comprises layers of bricks, expansion joints being provided extending in a width direction of said plate body.

6. A cooling element according to claim 1 wherein the said interior coolant carrying conduit includes an inlet adjacent said upper end and an outlet adjacent said lower end of said plate body, said holding element cooling tube including a holding element tube inlet and a holding element tube outlet located in the area of said plate body between said closed inlet and said closed outlet.

7. A cooling element according to claim 6, wherein: said holding element cooling tube is designed as a figure, said holding element cooling tube being positioned within said holding element.

8. A cooling element for furnaces comprising: a metallic plate having a first side intended as a furnace facing side with a face extending from an upper end of said metallic plate to a lower end of said metallic plate said face of said metallic plate defining recesses and projections forming brick work supports, a lower end projecting holding element portion formed integral with said metallic plate, said lower end projecting holding element extending a distance at said first side, beyond said face of said metallic plate, at least one coolant conduit formed within said plate; and, a refractory brick lining secured to said plate supported over said holding element portion.

9. A cooling element according to claim 8 further comprising: a holding element cooling tube, said holding element cooling tube extending through said holding element.

10. A method of providing a cooling element for furnaces comprising:

forming a metallic cooling plate with at least one cooling conduit formed in the interior of said plate and wherein said plate has a first side intended as a furnace facing hot side, said first side having a face defining a brick work support, said face extending from an upper end of said metallic cooling plate to a lower end of said metallic cooling plate, said metallic cooling plate having a lower outwardly projecting holding element portion, formed integral with said metallic cooling element, said outwardly extending holding element extending beyond said face, and securing a refractory lining to the first side of said plate above said holding element portion.

11. A method according to claim 10 wherein:

said the hot side of said plate is provided with refractory securing recesses forming refractory brick supports; positioning refractory brick in the supports; and, securing them to said plate.

* * * * *